US005909179A

United States Patent [19]

Hiltman

[11] Patent Number: 5,909,179

[45] Date of Patent: Jun. 1, 1999

[54] AUTOMATIC RESET FOR PERSONAL ALERT SAFETY SYSTEM

[75] Inventor: Paul D. Hiltman, Atlanta, Ga.

[73] Assignee: International Safety Instruments, Inc., Lawrenceville, Ga.

[21] Appl. No.: 09/016,974

[22] Filed: Feb. 2, 1998

[51] Int. Cl.[6] ..... G08B 23/00

[52] U.S. Cl. ..... 340/573.1; 340/693.6; 340/600; 340/575; 340/576

[58] Field of Search ..... 340/573.1, 693.6, 340/575, 576, 600

[56] References Cited

U.S. PATENT DOCUMENTS 4,196,429 4/1980 Davis ..... 340/669

5,745,038 4/1998 Vance ..... 340/575

*Primary Examiner*—Benjamin C. Lee

*Attorney, Agent, or Firm*—James B. Middleton

[57] ABSTRACT

Light is directed towards at least one eye of a user of a personal alert safety system (PASS), and the reflected light is sensed. When the eye blinks, there is an interruption of the reflected light signal indicating that the user is conscious. Electronic circuitry converts the variation in reflected light intensity into a corresponding variation in electrical signal. The PASS interprets this variable electrical signal as a reset indicator, so that as long as the wearer is conscious, the audio warning alarm in the PASS does not sound. The light is provided by a light emitting diode in the near infrared range, and the reflected beam may be sensed by a photodiode or phototransistor. Alternatively, ultra sound, or other light frequencies, may be used.

5 Claims, 1 Drawing Sheet

AUTOMATIC RESET FOR PERSONAL ALERT SAFETY SYSTEM

BACKGROUND OF THE INVENTION

1. Field of the Invention

This invention relates generally to safety alarms and the like, and is more particularly concerned with a method and apparatus for providing a reliable reset means for a personal alert safety system as long as the user is conscious.

2. Discussion Of The Prior Art

Firefighters, and others in hazardous locations, wear a personal alert safety system, or PASS. The PASS is designed to alert others in the event a person loses consciousness. In the demanding circumstances of a fire scene, for example, a firefighter could lose consciousness and no one may notice. The PASS, then, is designed to emit a signal that can be heard by close-by buddies in the event a firefighter loses consciousness.

The conventional PASS utilizes a motion sensor to determine whether or not the wearer is conscious, so the device must be moved periodically to indicate that the wearer is conscious. It will be understood, however, that a firefighter may need to be rather still at times, even though he is actively fighting a fire. As a result, the conventional PASS often indicates that the person is unconscious when he is not.

The PASS is designed to emit a pre-alert signal when the PASS has been motionless for a predetermined length of time. The wearer, if conscious, can then move, or hit the PASS device, and the device will reset. However, the requirement to take active steps to re-set the PASS takes time and attention away from the job at hand. Furthermore, other people in the vicinity may also hear the pre-alert signal and move in order to reset their own PASS, either mistaking the pre-alert signal for theirs, or simply being reminded that they must move occasionally.

There are times when the wearer of a PASS does not hear the pre-alert signal, and the PASS emits the full alarm signal, which is loud enough that others in the vicinity will hear the alarm. First, this requires that the wearer of the PASS use his hand in order to reset the PASS and stop the alarm from sounding. Next, others in the vicinity will stop what they are doing and go to the rescue of the person whose alarm sounded. As a result, several people are taken away from their duties, even though no one is in trouble.

In view of the above mentioned difficulties, firefighters frequently do not turn on their PASS. While this prevents false alarms, it also takes away the proposed benefit of the PASS. Thus, the prior art has not provided means for accurately determining when the wearer of a PASS device has lost consciousness so the PASS alert signal can be sounded appropriately.

SUMMARY OF THE INVENTION

The present invention provides means for sensing a normal, human motion, and means for resetting a PASS in response to that motion.

It is well known that a person who is conscious will blink his eyes periodically, typically every few seconds. The urge to blink is so strong that few people can refrain from blinking, even through conscious effort. Thus, it is almost axiomatic that, if a person is conscious, that person blinks his eyes every few seconds. The present invention therefore provides means for directing a beam at a person's eye, or eyes, and sensing the reflected beam. When the reflected beam is interrupted, it is an indication that the person has blinked, because the eyelid disrupts the beam. As a result, the interruptions in the reflected beam can be used as reset signals by the PASS device.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
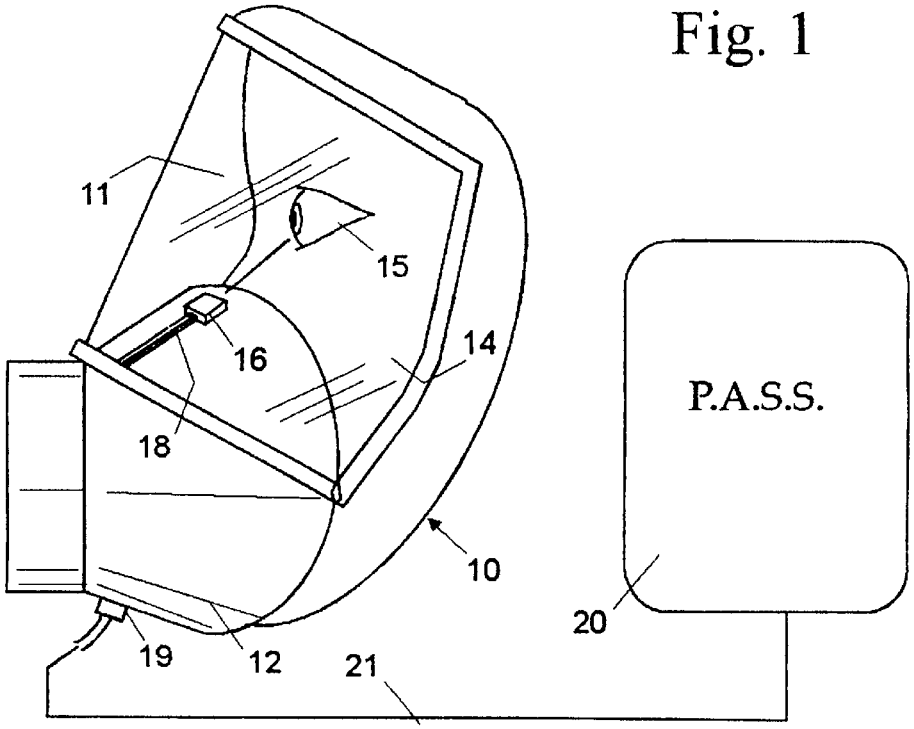
FIG. 1 is a partially schematic, side elevational view showing a face mask having the apparatus of the present invention mounted therein; and, FIG. 2 is a schematic diagram showing the operation of the system of the present invention.

Referring now more particularly to the drawings, and to that embodiment of the invention here presented by way of illustration, FIG. 1 depicts a face mask generally designated at 10, the face mask 10 including a viewing glass 11, and a nose cup 12. A wearer is shown at 14, having an eye 15.

As here shown, there is a source of light to be projected towards the eye 15, and a sensor to receive reflected light. While the source and sensor are indicated as a single package 16, those skilled in the art will understand that separate devices for the source and sensor are equally possible. Furthermore, while the preferred source is a source of near-infrared light, it will be readily understood that other frequencies of light may be used, and ultra sonic sound waves may be used. There are devices readily available to propagate the light, or ultra-sound, as desired, and there are sensors for each.

The important point as shown in FIG. 1 is that the device 16 is mounted adjacent to the eye 15. The location on the nose cup 12 is a reasonable mounting point, but other mountings are also possible. For example, for use by fire fighters, it may be desirable to mount the device 16 on the helmet because the helmet will always be worn, while a face mask may not always be worn.

Returning to FIG. 1 of the drawings, it will be seen that there is an electric cable 18 that connects to the device 16 and extends down the nose cup 12. The cable passes through the sealed connector 19 for connection outside the face mask 10.

FIG. 1 shows a PASS 20 schematically, connected to the cable 18 by a line 21. Those skilled in the art will understand that some electronics may be needed between the device 16 and the PASS 20 (such as for signal amplification).

Figure 2:
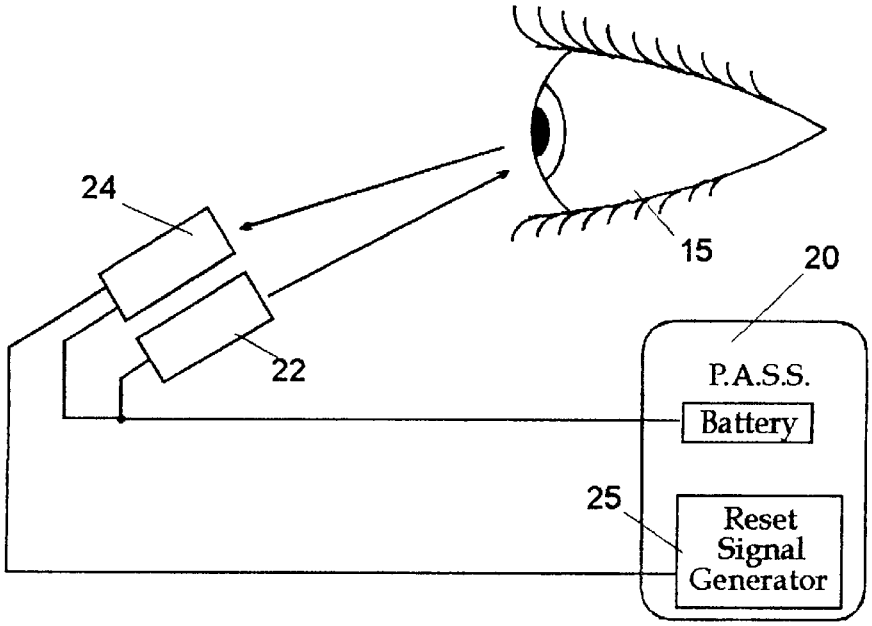

Attention is directed to FIG. 2 for a more detailed description of the system of the present invention. Here, for clarity, the device 16 is shown as a separate light source 22 and a reflected light sensor 24. The light source 22 may be a light-emitting diode (LED) which will propagate a beam of light (preferably infrared wavelengths so as not to distract the user) towards the eye 15. So long as the eye is open, the light beam will impinge on the eyeball, and light will be reflected and received by the sensor 24. The sensor 24 may be a photodiode, phototransistor or any similar sensor receptive to the source wavelengths.

As long as a person is in control of himself, he will blink his eyes periodically, usually every few seconds. During each blink, the eye 15 is covered with the eyelid, which has a significantly lower reflectivity than the eyeball surface. Hence, the sensor 24 output tends to vary with each blink.

Current PASS circuitry is designed to use such variable signals to automatically reset their timer mechanisms and prevent the audio alarm from sounding. A further variation in the reflected signal occurs when the leading edge of the eyelid moves across the eye, thereby disrupting the reflected signal further. The PASS can also use the resulting large signal change as the primary reset trigger.

The present invention therefore provides a very convenient means for resetting the PASS, and the reset is based on a highly reliable measure of consciousness. The arrangement can be provided for only one eye of the person, or for both eyes as desired, and near-infrared light, other light frequencies, ultrasound, or other beams may be used, so long as the beam can be directed at the eye, and the reflected beam sensed.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

What is claimed as the invention is:

1. In the combination of a personal alert safety system having an alert signal, reset means for preventing sound of said alert signal, and sensing means for controlling said reset means, the improvement wherein said sensing means comprising means for propagating a beam towards an eye of a user of said personal alert safety system, said beam reflecting from the eyeball of a user to provide a reflected beam, said reflected beam including variations due to periodic blinking of the eye of the user, means for receiving said reflected beam, means for converting said beam variations into corresponding electrical variations for resetting said personal alert safety system, wherein said user of said personal alert safety system is wearing a mask having a face plate and a nose cup, and wherein said means for propagating a signal is fixed to said nose cup adjacent to an eye of the user.

2. In the combination as claimed in claim 1, the further improvement wherein said means for propagating a signal comprises a light emitting diode.

3. A method for determining when a personal alert safety system ought to be reset, said method comprising the steps of: equipping a user of said personal alert safety system with a mask having a face plate and a nose cup with a means for propagating a beam fixed to said nose cup adjacent to at least one eye of the user, propagating said beam towards at least one eye of the user of the personal alert safety system, sensing said beam reflected from the eye and determining if said beam reflected from the eye is periodically interrupted, and resetting the personal alert safety system so long as said beam reflected from the eye is periodically interrupted.

4. A method as claimed in claim 3, wherein the said step of propagating a beam comprises the step of energizing a light emitting diode and directing the light towards the eye.

5. A method as claimed in claim 4, wherein said light emitting diode emits light in the near-infrared range.

* * * * *